US011221121B1

(12) United States Patent
Mori

(10) Patent No.: US 11,221,121 B1
(45) Date of Patent: Jan. 11, 2022

(54) VEHICULAR LAMP

(71) Applicant: STANLEY ELECTRIC CO., LTD., Tokyo (JP)

(72) Inventor: Taiki Mori, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/345,336

(22) Filed: Jun. 11, 2021

(30) Foreign Application Priority Data

Jun. 23, 2020 (JP) ..... JP2020-107676

(51) Int. Cl.
*F21S 41/176* (2018.01)
*F21S 41/37* (2018.01)
*F21S 41/275* (2018.01)

(52) U.S. Cl.
CPC ..... *F21S 41/37* (2018.01); *F21S 41/176* (2018.01); *F21S 41/275* (2018.01)

(58) Field of Classification Search
CPC ... F21S 41/176; F21S 43/16; F21S 41/25–275
See application file for complete search history.

(56) References Cited

U.S. PATENT DOCUMENTS 8,956,025 B2 2/2015 Kushimoto
9,574,733 B2 2/2017 Kushimoto
2020/0263850 A1* 8/2020 Kawaguchi ..... G02B 26/101

FOREIGN PATENT DOCUMENTS

JP 2011222238 A 11/2011
JP 5577138 B2 7/2014
JP 2018198139 A 12/2018

* cited by examiner

*Primary Examiner* — Sean P Gramling
(74) *Attorney, Agent, or Firm* — Holtz, Holtz & Volek PC

(57) ABSTRACT

A vehicular lamp includes a light source, a mirror unit that emits a scanning light beam by reflecting a light beam from the light source by reciprocating rotation around two axes, a reflection type phosphor unit that receives the scanning light beam from the mirror unit to produce an image on a phosphor surface, and a projection lens unit that is disposed to face the phosphor surface of the reflection type phosphor unit and through which light emitted from the image incident from the reflection type phosphor unit passes. The projection lens unit has a bottom surface on the inner side and a chamfered surface on the outer side in a radial direction on the incident side.

9 Claims, 12 Drawing Sheets

$$\frac{\text{CONDENSING LENS FOCAL LENGTH Fi}}{\text{COLLIMATOR LENS FOCAL LENGTH Fs}} = \frac{\text{IMAGING SIZE Di}}{\text{LIGHT SOURCE SIZE Ds}}$$

VEHICULAR LAMP

BACKGROUND OF THE INVENTION

1. Field of the Invention

The present invention relates to a vehicular lamp that irradiates an irradiation area with a scanning light beam.

2. Description of the Related Art

Vehicular lamps are known in which a scanning light beam for two-dimensional scanning is produced by using a MEMS mirror and an image produced on a phosphor plate by the scanning light beam is projected onto an irradiation area in front of a vehicle by a projection lens unit (for example, JP5577138B2 and JP2018-198139A).

JP5577138B2 discloses a vehicular headlight provided with a reflection type phosphor plate.

JP2018-198139A discloses a vehicular lamp (for example, a vehicular headlight) provided with a transmission type phosphor plate.

It is desirable from the viewpoint of lens efficiency that the phosphor plate and the projection lens unit are disposed to be brought close to each other on the same axis. On the other hand, the phosphor plate generates heat when converting the wavelength of excitation light. The phosphor plate needs to be cooled because conversion efficiency decreases at high temperature.

Since the phosphor plate of the vehicular headlight of JP5577138B2 is a reflection type, a heat sink with a large area can be mounted to the back surface side of the phosphor plate to obtain a sufficient cooling effect. However, the reflection type phosphor plate obliquely receives the scanning light beam from the MEMS mirror on the surface.

Therefore, the reflection type phosphor plate needs to be disposed sufficiently away from the projection lens unit in order to avoid interference of a peripheral edge portion of the end on the phosphor plate side of the projection lens unit with the scanning light beam. This leads to a decrease in lens efficiency.

Since the phosphor plate of the vehicular lamp of JP2018-198139A is a transmission type, the phosphor plate can be disposed sufficiently close to the projection lens unit. However, the transmission type phosphor plate has to be open on both surfaces, and thus it is not possible to mount a heat sink to the central portion of the transmission type phosphor plate.

SUMMARY OF THE INVENTION

An object of the present invention is to provide a vehicular lamp in which it is possible to increase a lens efficiency of a projection lens unit while using a reflection type phosphor unit that can be cooled smoothly.

According to an aspect of the present invention, there is provided a vehicular lamp including:

a light source that emits a light beam;

a mirror unit that emits a scanning light beam by reflecting the light beam from the light source by performing reciprocating rotation around two axes;

a reflection type phosphor unit that has a phosphor surface and receives the scanning light beam from the mirror unit to produce an image on the phosphor surface; and a projection lens unit that has an optical axis parallel to or common to a central axis perpendicular to the phosphor surface of the reflection type phosphor unit, and emits light emitted from the image incident from the reflection type phosphor unit in a direction from an incident end point on the optical axis to an emission end point on the optical axis to project the light onto an irradiation area, in which in a case where an inclined plane that intersects with the optical axis at a predetermined point on the reflection type phosphor unit side with respect to the incident end point of the projection lens unit on the optical axis and becomes more distant from the optical axis in a predetermined radial direction of the projection lens unit as the inclined plane proceeds from the predetermined point toward the emission end point on the optical axis is defined, the projection lens unit has a bottom surface that is formed inside the inclined plane in the predetermined radial direction of the projection lens unit at a position of the incident end point and on which the light emitted from the image from the reflection type phosphor unit is incident, and a chamfered surface that is included in the inclined plane and formed outside the bottom surface in the predetermined radial direction.

According to the present invention, since the projection lens unit has the chamfered surface at the incident end point, the optical path of the scanning light beam from the mirror unit side to the reflection type phosphor unit can be shifted toward the emission end point of the projection lens unit while avoiding interference with the projection lens unit. As a result, it is possible to enhance the lens efficiency while using the reflection type phosphor unit that can be cooled smoothly.

Preferably, in the vehicular lamp according to the present invention, a relative positional relationship between the mirror unit and the reflection type phosphor unit is set such that at least a part of the scanning light beam from the mirror unit to the reflection type phosphor unit crosses a projection plane obtained by projecting the chamfered surface onto a vertical plane that includes the incident end point and is perpendicular to the optical axis.

According to this configuration, the optical path of the scanning light beam from the mirror unit side to the reflection type phosphor unit can be brought sufficiently close to the chamfered surface while avoiding interference with the projection lens unit.

Preferably, the vehicular lamp according to the present invention further includes:

a condensing lens that condenses the scanning light beam from the mirror unit on the reflection type phosphor unit such that the condensing lens is at least partially located within a range between both ends of the chamfered surface in the predetermined radial direction and within a range between the projection plane and the chamfered surface in a direction of the optical axis.

According to this configuration, the distance to the reflection type phosphor unit can be shortened by bringing the condensing lens sufficiently close to the reflection type phosphor unit. In this way, imaging at the reflection type phosphor unit can be made small, and thus the image quality can be improved.

Preferably, in the vehicular lamp according to the present invention, the phosphor surface of the reflection type phosphor unit has a rectangular shape having a short side and a long side, and the predetermined radial direction is a direction parallel to the short side.

According to this configuration, the dimension of the required chamfered surface can be shortened in the predetermined radial direction.

Preferably, in the vehicular lamp according to the present invention.

the vehicular lamp is a vehicular headlight, and a relative positional relationship between the mirror unit and the reflection type phosphor unit is set such that scanning with the scanning light beam in directions of the long side and the short side on the phosphor surface of the reflection type phosphor unit produces images in a horizontal direction and a vertical direction of the irradiation area.

According to this configuration, the vehicular lamp can be applied to a vehicular headlight to adequately produce an irradiation area of the vehicular headlight.

These and other aspects, objects, and features of the present Invention will be understood and appreciated by those skilled in the art upon studying the following specification, claims, and appended drawings.

BRIEF DESCRIPTION OF THE DRAWINGS

The figures described below set out and illustrate a number of exemplary embodiments of the disclosure. Throughout the drawings, like reference numerals refer identical or functionally similar elements. The drawings are illustrative in nature and not drawn to scale.

DESCRIPTION OF THE PREFERRED EMBODIMENTS

The following detailed description is made with reference to the figures. Exemplary embodiments are described to illustrate the subject matter of the Invention, not to limit its scope, which is defined solely by the appended claims.

(Overview of Vehicular Headlight)

Figure 1:
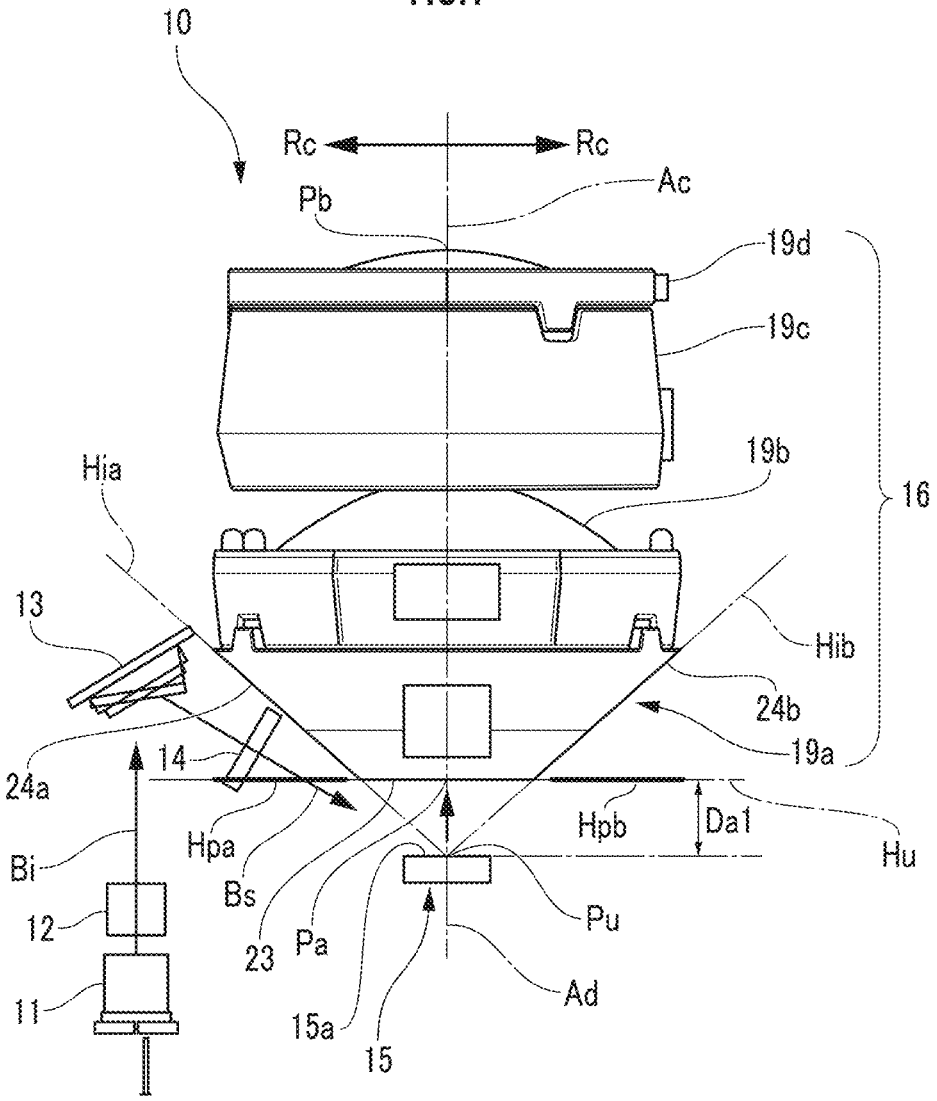
FIG. 1 is a configuration diagram of a vehicular headlight.

FIG. 1 is a configuration diagram of a vehicular headlight 10. The vehicular headlight 10 as a vehicular lamp is mounted to a vehicle and irradiates an irradiation area in front of the vehicle.

The vehicular headlight 10 includes a laser light source 11, a collimator lens 12, a MEMS (Micro Electro Mechanical Systems) mirror unit 13, a condensing lens 14, a reflection type phosphor plate 15, and a projection lens unit 16. The projection lens unit 16 has projection lenses 19*a* to 19*d* in order from the side closest to the reflection type phosphor plate 15.

The laser light source 11 emits a light beam Bi. The light beam Bi that is emitted by the laser light source 11 is blue. The emitted light beam Bi passes through the collimator lens 12 and is then incident on the MEMS mirror unit 13. The MEMS mirror unit 13 performs reciprocating rotation around two axes; a first axis Ay and a second axis Ax, which will be described later, to reflect the light beam Bi. The reflected light beam Bi becomes a scanning light beam Bs, which is emitted from the MEMS mirror unit 13. The scanning light beam Bs passes through the condensing lens 14 and is then incident on the reflection type phosphor plate 15.

The reflection type phosphor plate 15 as a reflection type phosphor unit encloses phosphor particles. The phosphor particles use the scanning light beam Bs as excitation light to perform wavelength conversion of a part of the scanning light beam Bs from blue to yellow. In this way, the scanning light beam Bs that is emitted from the reflection type phosphor plate 15 becomes white, which is a mixture of blue and yellow. On the other hand, since the reflection type phosphor plate 15 functions as a phosphor unit, an image of Lambert emission (in the case of the vehicular headlight 10, it is also called a "light distribution pattern" instead of an image) is produced on the phosphor surface (which also serves as both an incident surface and an emission surface) of the reflection type phosphor plate 15 by the scanning light beam Bs from the MEMS mirror unit 13.

(Light Deflector)

Figure 2:
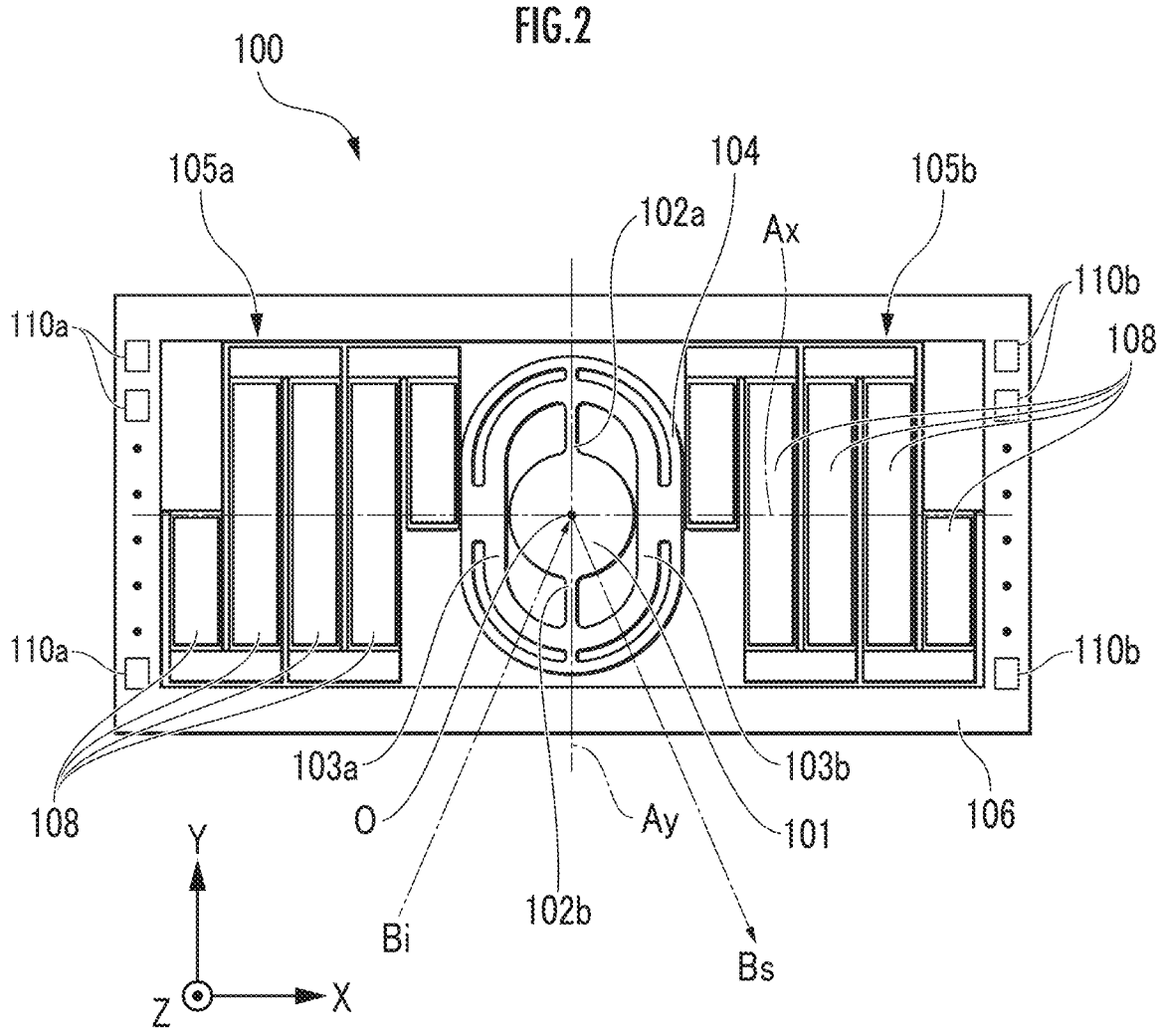
FIG. 2 is a front view of a light deflector provided with a MEMS mirror unit as a mirror unit.

Before the main configuration of the vehicular headlight 10 is described, an example of the MEMS mirror unit 13 will be described. FIG. 2 is a front view of a light deflector 100 that includes the MEMS mirror unit 13 as a mirror unit 101. The light deflector 100 is a MEMS device.

Here, for convenience of description of the configuration, a three-axis coordinate system is defined. The peripheral contour of the light deflector 100 is rectangular when viewed in a front view of the light deflector 100. An X axis and a Y axis are parallel to the long side and the short side of the light deflector 100, respectively. AZ axis is parallel to a thickness direction of the light deflector 100.

FIG. 2 illustrates the light deflector 100 in a state when the operation thereof is stopped. When the light deflector 100 is operated, a movable portion of the light deflector 100 is displaced from the state illustrated in FIG. 2.

The light deflector 100 of MEMS includes the mirror unit 101, torsion bars 102*a* and 102*b*, inner piezoelectric actuators 103*a* and 103*b*, a movable frame 104, outer actuators 105*a* and 105*b*, and a fixed frame 106.

The mirror unit 101 is located at the center of the light deflector 100 and has a circular shape in this example. The light beam Bi is incident on a center O of the mirror unit 101 from a light source (not illustrated). The mirror unit 101 performs reciprocating rotation around two axes; the first axis Ay and the second axis Ax orthogonal to each other at the center O by the operation of an inner piezoelectric actuator 103 (a general term for the inner piezoelectric actuators 103*a* and 103*b*) and an outer actuator 105 (a general term for the outer actuators 105*a* and 105*b*). In this way, the light beam Bi is reflected by the mirror unit 101 to become the scanning light beam Bs, which is emitted from the mirror unit 101. The scanning light beam Bs performs raster scan in the irradiation area.

The inner piezoelectric actuators 103*a* and 103*b* are disposed on both sides of the mirror unit 101 in the X-axis direction and are coupled to each other on the first axis Ay to form an annular body. The annular body has a contour in which both sides in the Y-axis direction are semicircles and the middle is a straight line, and surrounds the mirror unit 101.

The movable frame 104 has the same shape as the inner piezoelectric actuator 103 (a general term for the inner piezoelectric actuators 103*a* and 103*b*) and surrounds the inner piezoelectric actuator 103.

The torsion bars 102*a* and 102*b* protrude in opposite directions in the Y-axis direction from the mirror unit 101 and extend along the first axis Ay. Each torsion bar 102 (a general term for the torsion bars 102*a* and 102*b*) is coupled to the inner periphery of the movable frame 104 at the tip thereof and coupled to the inner piezoelectric actuator 103 at the intermediate portion thereof.

Each of the outer actuators 105*a* and 105*b* is disposed on each side in the X-axis direction with respect to the movable frame 104, and is interposed between the movable frame 104 and the fixed frame 106. The outer actuator 105 (a general term for the outer actuators 105*a* and 105*b*) includes a plurality of cantilevers 118 coupled in series in an array in a meander pattern.

Electrode pads 110*a* and 110*b* are formed at the short side portion of the fixed frame 106. The light deflector 100 is used in a state of being enclosed in a package (not illustrated). At that time, each electrode pad 110 (a general term for the electrode pads 110*a* and 110*b*) is connected to the inner piezoelectric actuator 103 and the movable frame 104 through wiring (not illustrated) in the light deflector 100 to supply a drive voltage.

The operation of the light deflector 100 will be briefly described. The inner piezoelectric actuator 103 causes the mirror unit 101 to perform reciprocating rotation around the first axis Ay at a resonance frequency (for example, about 16 kHz) through the torsion bar 102. The outer actuator 105 causes the movable frame 104 to perform reciprocating rotation around a rotation axis parallel to the X axis at a non-resonance frequency (for example, 60 Hz). In this way, the mirror unit 101 performs reciprocating rotation around the second axis Ax and the first axis Ay, respectively. When the mirror unit 101 faces directly forward during the operation of the light deflector 100, the second axis Ax and the first axis Ay are parallel to the X axis and the Y axis, respectively.

Both the inner piezoelectric actuator 103 and the outer actuator 105 are unipolar type piezoelectric actuators.

(Configuration of Projection Lens Unit)

Figure 3A:
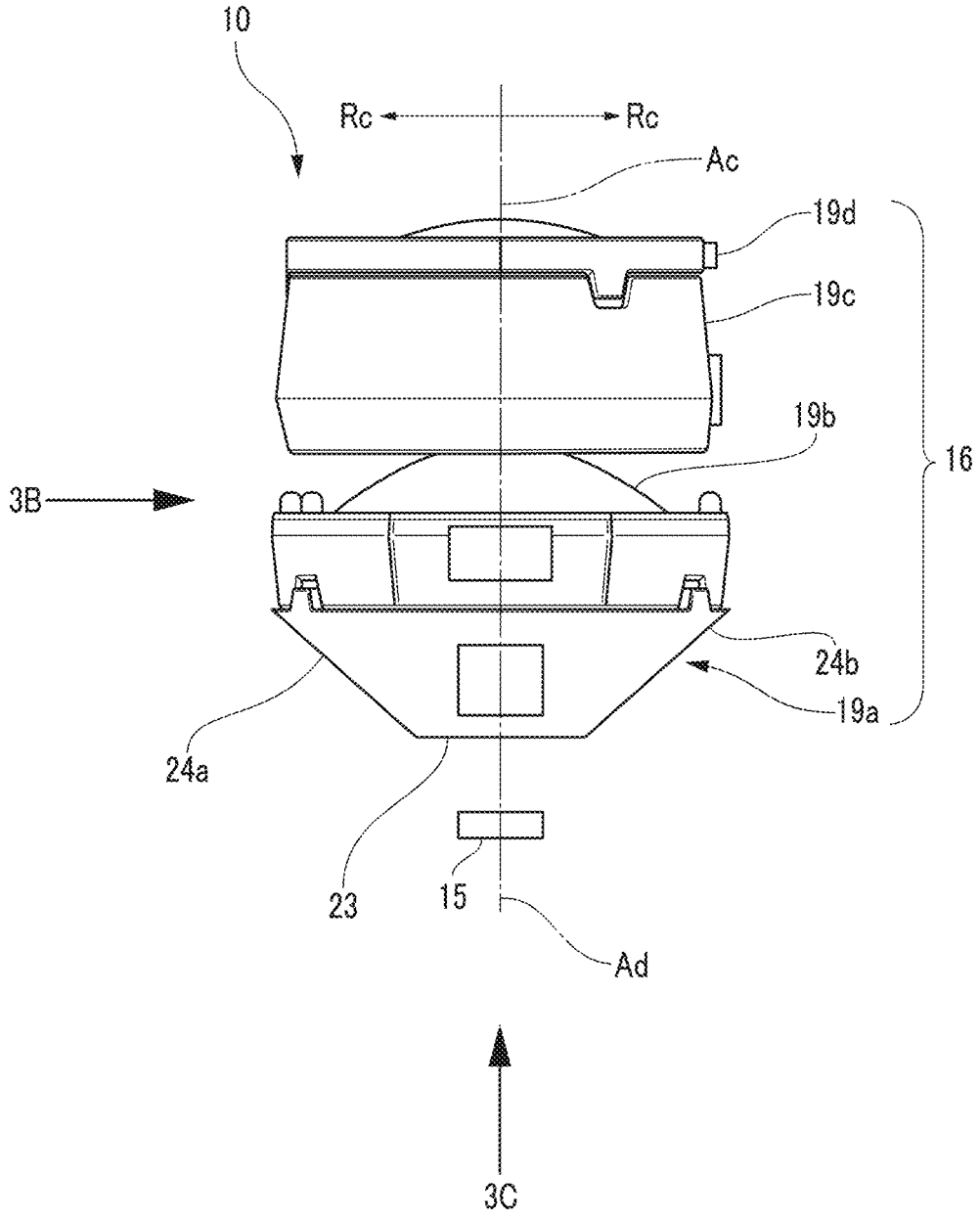
FIG. 3A is a front view of the set of a reflection type phosphor plate 15 and a projection lens unit 16.
Figure 3B:
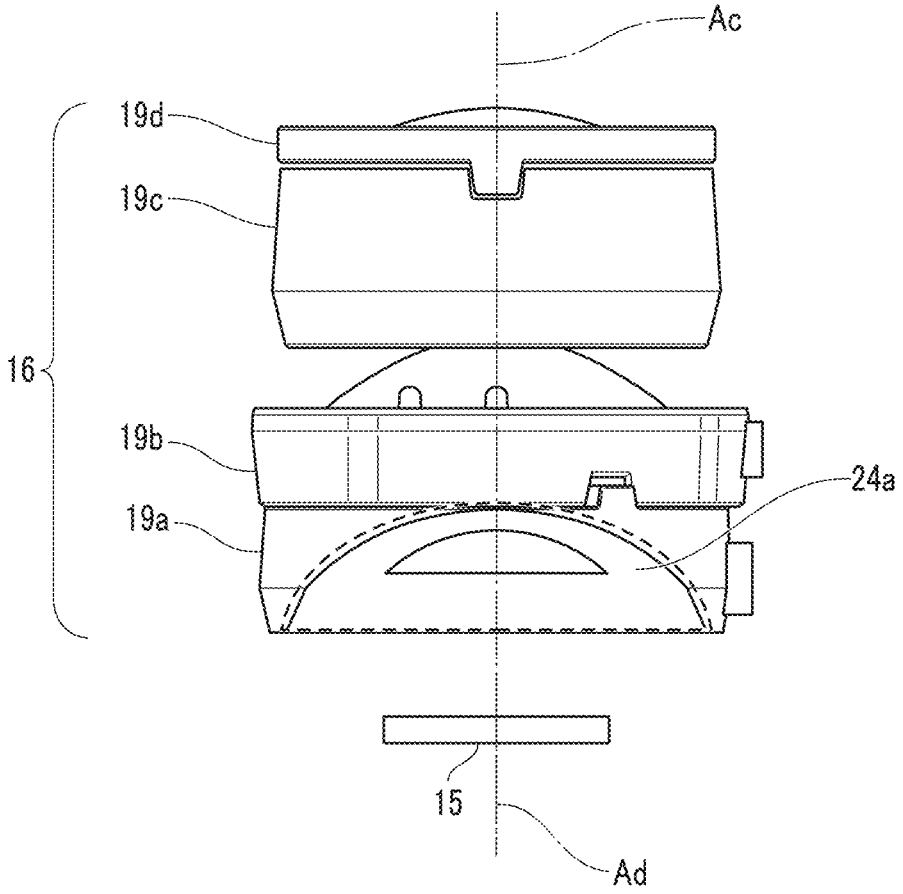
FIG. 3B is a view in the direction of an arrow 3B in FIG. 3A.
Figure 3C:
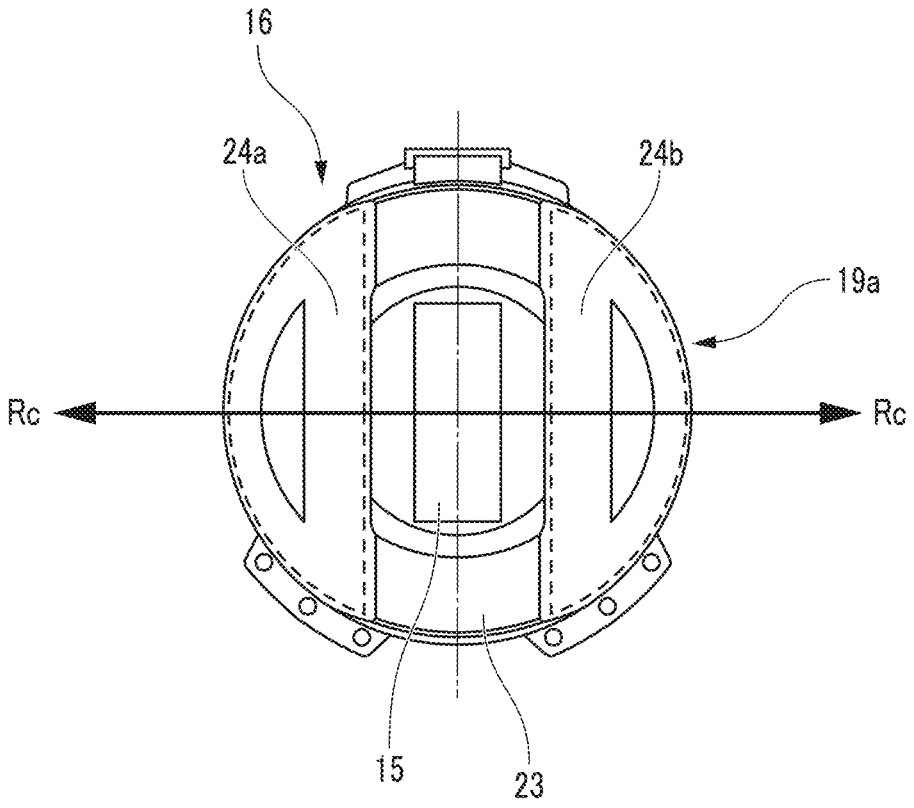
FIG. 3C is a view in the direction of an arrow 3C in FIG. 3A.

FIG. 3A is a front view of the set of the reflection type phosphor plate 15 and the projection lens unit 16, FIG. 3B is a view in the direction of the arrow 3B in FIG. 3A, and FIG. 3C is a view in the direction of the arrow 3C in FIG. 3A. FIGS. 3B and 3C are a left side view and a bottom view, respectively. The reflection type phosphor plate 15 has a rectangular shape having a short side and a long side.

In FIG. 1 described above, for the sake of simplification of the drawing, the illustration of the laser light source 11, the collimator lens 12, the MEMS mirror unit 13, and the condensing lens 14 on the chamfered surface 24*b* side is omitted. The scanning light beam Bs is incident on the reflection type phosphor plate 15 from each side of the chamfered surfaces 24*a* and 24*b*, and the scanning light beam Bs produces an image of Lambert emission on the image surface of the reflection type phosphor plate 15.

In FIG. 1, the definition of each symbol is as follows.

Ac: optical axis of the projection lens unit 16

Ad: central axis perpendicular to the phosphor surface of the reflection type phosphor plate 15

In this embodiment, the optical axis Ac of the projection lens unit 16 is common to the central axis Ad. However, the optical axis Ac and the central axis Ad are not limited to being common, and may be disposed in parallel with each other.

Rc: predetermined radial direction of the projection lens unit 16

Pa, Pb: incident end point and emission end point of the projection lens unit 16, respectively The Lambert emission of the image on the phosphor surface of the reflection type phosphor plate 15 enters the projection lens unit 16 from the incident end point Pa on the optical axis Ac, passes through the projection lens unit 16, is emitted from the emission end point Pb to the outside of the projection lens unit 16, and is projected onto the irradiation area.

Pu: predetermined point set on the reflection type phosphor plate 15 side rather than the incident end point Pa on the optical axis Ac In this embodiment, the predetermined point Pu is set on the phosphor surface of the reflection type phosphor plate 15.

Hia, Hib: inclined planes intersecting with the optical axis Ac at the predetermined point Pu In the embodiment, the inclined planes Hia and Hib are flat planes. However, the inclined planes Hia and Hib may be curved planes.

Da1: distance between the incident end point Pa and the phosphor surface 15*a* of the reflection type phosphor plate 15 (the surface 15*a* on which an image is produced by the scanning light beam Bs from the MEMS mirror unit 13) in the direction of the optical axis Ac The predetermined radial direction Rc is a direction perpendicular to the optical axis Ac. The inclined planes Hia and Hib are in a symmetrical positional relationship with each other with respect to the optical axis Ac, and the distances from the inclined planes Hia and Hib to the optical axis Ac in the predetermined radial direction Rc increase as they go toward the emission end point Pb side in the direction of the optical axis Ac.

A bottom surface 23 is formed inside both inclined planes Hi (a general term for the inclined planes Hia and Hib) in the predetermined radial direction Rc of the projection lens unit 16. A chamfered surface 24 (a general term for the chamfered surfaces 24*a* and 24*b*) is present outside the bottom surface 23 in the predetermined radial direction Rc. The chamfered surface 24 is included in the inclined plane Hi and is the portion of the inclined plane Hi.

In FIG. 1, projection planes Hpa and Hpb are projection planes that are produced on a vertical plane Hu when the chamfered surfaces 24*a* and 24*b* are parallel-projected onto the vertical plane Hu in parallel with the optical axis Ac.

The chamfered surface 24 is formed on the projection lens 19*a*, so that it becomes possible to shift the optical path of the scanning light beam Bs from the MEMS mirror unit 13 to the reflection type phosphor plate 15 toward the emission end point Pb in the direction of the optical axis Ac.

Further, in the vehicular headlight 10, the relative positional relationship between the MEMS mirror unit 13 and the reflection type phosphor plate 15 is set such that at least a part (including the whole) of the scanning light beam Bs from the MEMS mirror unit 13 to the reflection type phosphor plate 15 crosses a projection plane Hp (a general term for the projection planes Hpa and Hpb) that is produced by parallel-projecting the chamfered surface 24 onto the vertical plane Hu, which passes through the incident end point Pa of the projection lens unit 16 perpendicularly to the optical axis Ac, in the direction of the optical axis Ac.

Further, the condensing lens 14 has a function of condensing the scanning light beam Bs from the MEMS mirror unit 13 on the reflection type phosphor plate 15. The condensing lens 14 is at least partially (including entirely) inserted within the range between both ends of the projection plane Hp in the radial direction (the right-left direction in FIG. 1) of the projection lens unit 16 and within the range between the chamfered surface 24 and the projection plane Hp in the direction of the optical axis Ac.

Figure 4:
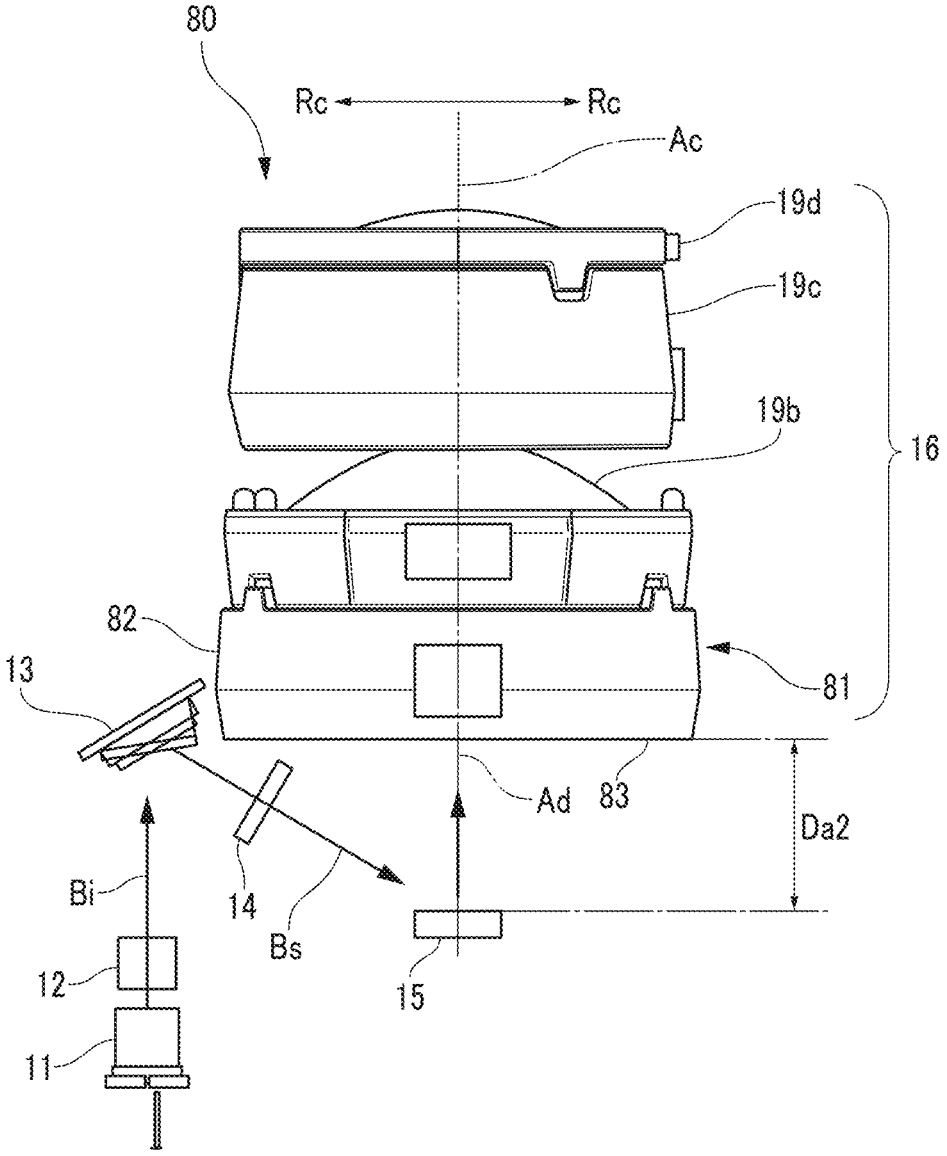
FIG. 4 is a diagram illustrating a configuration of a vehicular headlight of a comparative example.

As a result, the optical path of the scanning light beam Bs from the MEMS mirror unit 13 to the reflection type phosphor plate 15 can be shifted from the incident end point Pa toward the emission end point Pb in the direction of the optical axis Ac. This will be described by comparing FIG. 1 and FIG. 4. FIG. 4 illustrates the configuration of a vehicular headlight 80 of a comparative example. The same elements as the elements of the vehicular headlight 10 are denoted by the reference numerals given to the elements of the vehicular headlight 10, and the description thereof is omitted. The differences from the vehicular headlight 10 will be described.

The vehicular headlight 80 is provided with a projection lens 81 instead of the projection lens 19*a* of the vehicular headlight 10. Unlike the projection lens 19*a*, the projection lens 81 does not have the chamfered surface 24. Therefore, the exposed-side outer surface of the projection lens 81 includes a cylindrical side surface 82 and a flat circular bottom surface 83. The optical path of the scanning light beam Bs from the MEMS mirror unit 13 to the reflection type phosphor plate 15 needs to avoid interference with the projection lens 81. Therefore, the reflection type phosphor plate 15 has to be disposed sufficiently away from the circular bottom surface 83 in the direction of the optical axis Ac. As a result, a dimension Da2 between the reflection type phosphor plate 15 and the projection lens 81 in the direction of the optical axis Ac becomes larger than the dimension Da1 (FIG. 1) (Da2>Da1).

Figure 5:
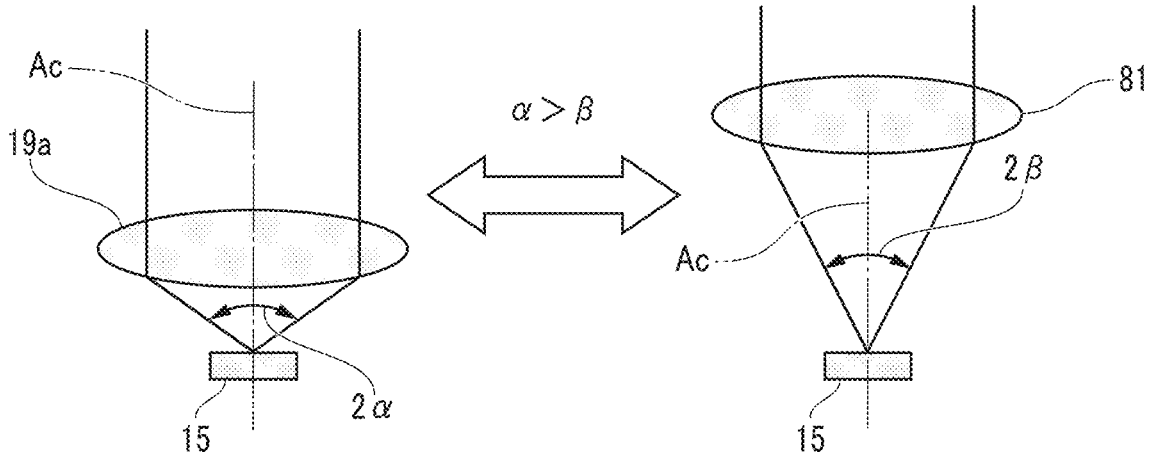
FIG. 5 is a diagram illustrating the relationship between a distance between the reflection type phosphor plate and a projection lens in an optical axis direction and an angular range of light from the reflection type phosphor plate, which is incident on the projection lens from the reflection type phosphor plate.

FIG. 5 is a diagram illustrating the relationship between the distance between the reflection type phosphor plate 15 and the projection lens 19*a* in the direction of the optical axis Ac and the angular range of the light from the reflection type phosphor plate 15, which is incident on the projection lens 19*a* from the reflection type phosphor plate 15. The angular range when the distance between the reflection type phosphor plate 15 and the projection lens 19*a* in the direction of the optical axis Ac is small is $2\alpha$. In contrast, the angular range when the distance is large is $2\mu$. Since $\alpha>\mu$, the shorter the distance between the reflection type phosphor plate 15 and the projection lens 19*a* is, the smaller the amount of light leakage becomes, and thus the lens efficiency of the projection lens 19*a* becomes higher.

When Da1 in the vehicular headlight 10 of FIG. 1 and Da2 in the vehicular headlight 80 of FIG. 4 are compared. Da1<Da2. Therefore, it can be seen that the vehicular headlight 10 has higher lens efficiency than the vehicular headlight 80.

Further, the optical path of the scanning light beam Bs from the MEMS mirror unit 13 to the reflection type phosphor plate 15 can be shifted toward the emission end point Pb side in the direction of the optical axis Ac, so that the laser light source 11, the collimator lens 12, and the MEMS mirror unit 13 can also be shifted toward the emission end point Pb in the direction of the optical axis Ac. In this way, the dimension of the vehicular headlight 10 in the direction of the optical axis Ac can be shortened, and thus downsizing of the vehicular headlight 10 can be attained.

Figure 6:
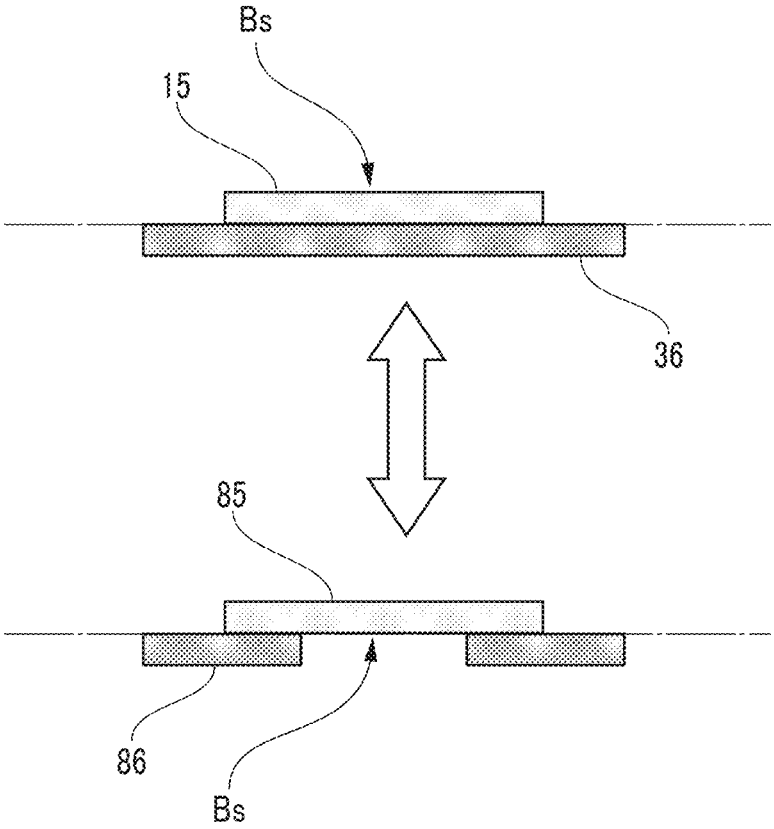
FIG. 6 is a diagram comparing the cooling-ability of the reflection type phosphor plate and the cooling-ability of a transmission type phosphor plate.

FIG. 6 is a diagram comparing the cooling-ability of the reflection type phosphor plate 15 and the cooling-ability of a transmission type phosphor plate 85. In the reflection type phosphor plate 15, it is possible to mount a full-face heat sink 36 on the back surface side. In contrast, in the transmission type phosphor plate 85, in order to secure the passage of the scanning light beam Bs, it is difficult to mount the full-face heat sink 36, and a frame-type heat sink 86 is used instead of the full-face heat sink 36. The frame-type heat sink 86 causes the central portion of the transmission type phosphor plate 85 to be open and allows contact only at the peripheral edge portion.

The phosphor particles generate heat when performing the wavelength conversion of the scanning light beam Bs by using the scanning light beam Bs as excitation light. Then, when the temperature of the phosphor particles becomes high, the efficiency of the wavelength conversion decreases. The vehicular headlight 10 is provided with the reflection type phosphor plate 15, so that the conversion efficiency of the phosphor particles can be maintained favorably.

Figure 7:
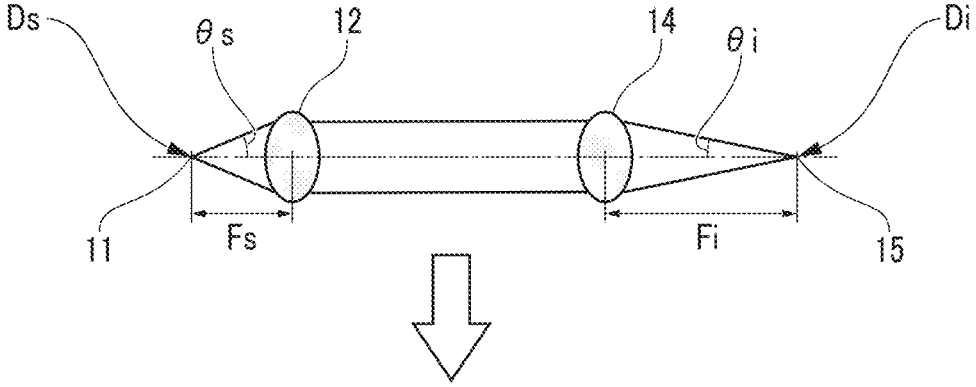
FIG. 7 is a diagram illustrating the relationship between a focal length of a collimator lens, a focal length of a condensing lens, a light source size of a laser light source, and an imaging size on the reflection type phosphor plate.

FIG. 7 is a diagram illustrating the relationship between a focal length Fs of the collimator lens 12, a focal length Fi of the condensing lens 14, a light source size Ds of the laser light source 11, and an imaging size Di in the reflection type phosphor plate 15. Due to the chamfered surface 24, it becomes possible to bring the condensing lens 14 sufficiently close to the reflection type phosphor plate 15 without interfering with the projection lens 19*a*. As a result, the focal length Fi can be shortened, so that the imaging size Di is reduced. In this way, the resolution of the image that is produced on the reflection type phosphor plate 15 can be increased.

Figure 8:
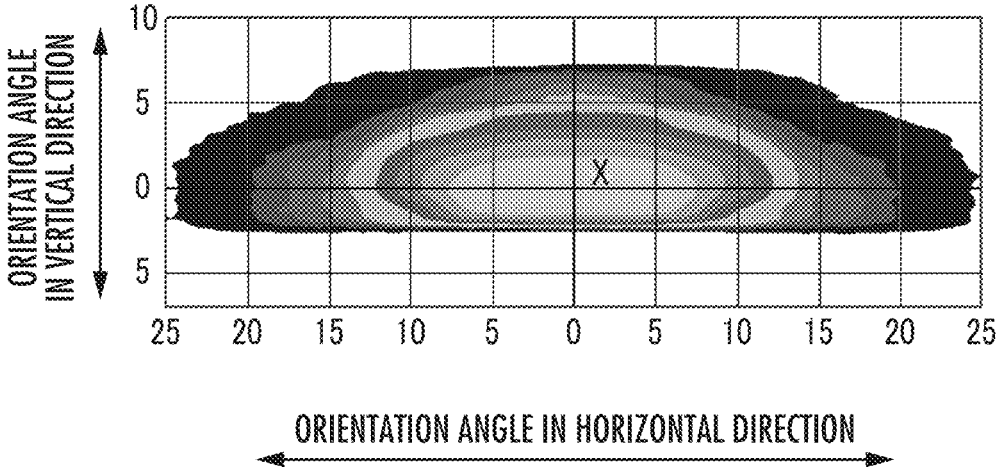
FIG. 8 is a diagram illustrating a light distribution pattern that is produced in an irradiation area by the vehicular headlight.

FIG. 8 is a diagram illustrating a light distribution pattern that is produced in the irradiation area by the vehicular headlight 10. The irradiation area is produced in front of the vehicle to which the vehicular headlight 10 is mounted. The illuminance in the irradiation area is color-coded according to the levels of values. The actual light distribution pattern diagram has colors. However, in FIG. 8, each color is represented by a gray scale of a corresponding monochrome. FIG. 8 illustrates that the maximum illuminance is obtained at a location where both light orientation angles in the horizontal and vertical directions are 0°, and the illuminance decreases as the light orientation angle increases from 0° in both the horizontal and vertical directions.

As described above, the phosphor surface of the reflection type phosphor plate 15 has a rectangular shape having a long side and a short side. The relative positional relationship between the MEMS mirror unit 13 and the reflection type phosphor plate 15 is set such that the scanning of the phosphor surface with the scanning light beam Bs in the directions of the long side and short side produces images in the horizontal and vertical directions, respectively, in the irradiation area in front of the vehicular headlight 10. In this way, the vehicular headlight 10 can produce an image (light distribution pattern) suitable for the shape of the irradiation area in the irradiation area.

Figure 9:
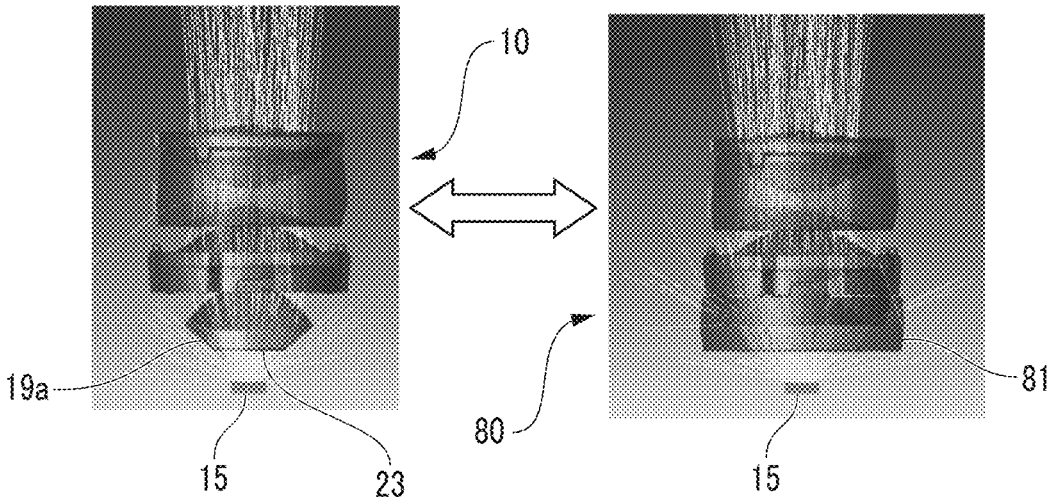
FIG. 9 is a comparison diagram in which light rays are traced by the projection lens of an embodiment and a projection lens of the comparative example.

FIG. 9 is a comparison diagram in which light rays are traced by the projection lens 19*a* of the vehicular headlight 10 and the projection lens 81 of the vehicular headlight 80. In the projection lens 81, the distance from the reflection type phosphor plate 15 in the direction of the optical axis Ac is set to Da1 (FIG. 1), unlike the description of FIG. 4 described above.

Due to the formation of the chamfered surface 24, some light rays from the reflection type phosphor plate 15 are not incident on the projection lens 19*a* and leak out of the projection lens 19*a*. When the lens efficiency was calculated, it was 100% when there is no bottom surface 23 (the configuration in the right-side drawing of FIG. 9), whereas it dropped to 93.2% due to the formation of the bottom surface 23. However, although not illustrated in the drawing, when the distance between the reflection type phosphor plate 15 and the projection lens 81 in the direction of the optical axis Ac was set to Da2 as in FIG. 4, the lens efficiency was reduced to 40%.

However, in the case where there is no bottom surface 23 (the configuration in the right-side drawing of FIG. 9), although the lens efficiency is 100%, the MEMS mirror unit 13 is disposed so as to overlap the projection lens 81, which is a form that cannot be realized. Therefore, the substantially highest lens efficiency is 93.2% when the bottom surface 23 is formed. Therefore, the substantial form of the cylindrical side surface 82 is separated by Da2, and when the bottom surface 23 is formed, the lens efficiency can be 2.3 times (=93.2%/40%) higher than the lens efficiency in the cylindrical side surface 82.

From the above, in the present embodiment, due to the reflection type phosphor plate 15 that maintains high lens efficiency, it becomes possible to mount the full-face heat sink 36 on the back surface side, so that the cooling-ability is increased, and the conversion efficiency of the phosphor particles can be maintained favorably.

Another Embodiment

Figure 10A:
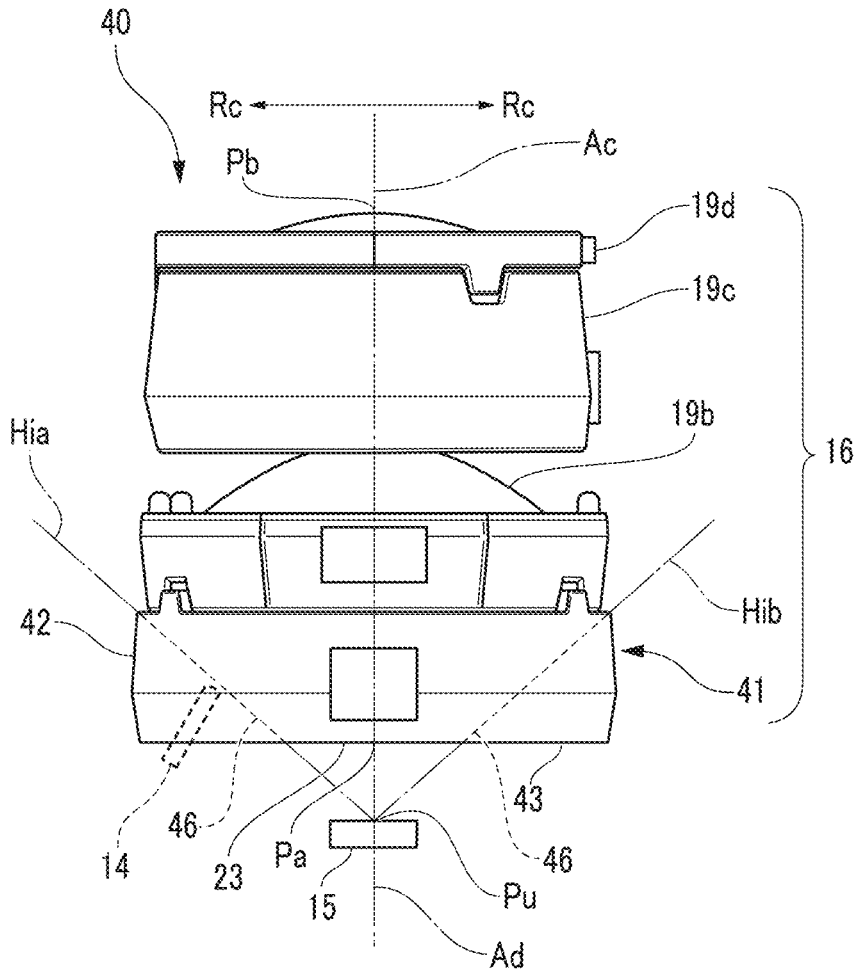
FIG. 10A is a front view of a vehicular headlight as another embodiment of the present invention.
Figure 10B:
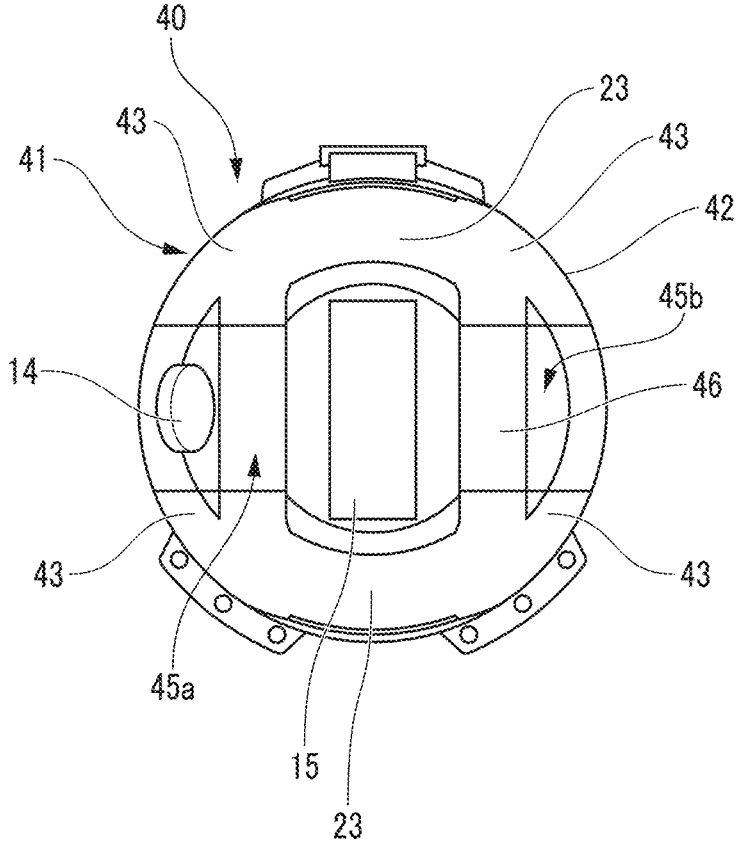
FIG. 10B is a bottom view of the vehicular headlight of FIG. 10A.

FIGS. 10A and 10B are a front view and a bottom view of a vehicular headlight 40 as another embodiment of the present invention. The differences from the vehicular headlight 10 will be described. The vehicular headlight 40 is provided with a projection lens 41 instead of the projection lens 19*a* of the vehicular headlight 10. The projection lens 41 is provided with a cylindrical side surface 42 and a bottom surface 43. The surface of the projection lens 41 facing the projection lens 19*b* is formed to have the same contour surface as the projection lens 19*a* of the vehicular headlight 10.

The cylindrical side surface 42 and the bottom surface 43 are different from the cylindrical side surface 82 and the circular bottom surface 83 of the projection lens 81 (FIG. 4) in that the bottom surface 23 and chamfered grooves 45*a* and 45*b* are formed. A chamfered groove 45 (a general term for the chamfered grooves 45*a* and 45*b*) has a chamfered surface 46 as a bottom surface.

The projection lens 41 is different from the projection lens 19*a* in that the chamfered surfaces 24*a* and 24*b* are replaced with the chamfered surfaces 46 of the chamfered grooves 45*a* and 45*b*.

As described above, at the position of the incident end point of the projection lens 81, as the bottom surface, in addition to the bottom surface 23 (a first bottom surface) facing the reflection type phosphor plate 15, the bottom surface 43 (a second bottom surface) is formed around the chamfered grooves 45*a* and 45*b*, so that the area of the bottom surface is increased. Therefore, it is possible to make the lens efficiency higher than the lens efficiency in the embodiment (FIGS. 3A to 3C). Further, since another embodiment also includes a reflection type phosphor plate, the full-face heat sink 36 can be mounted on the back surface side, so that the cooling-ability is increased, and the conversion efficiency of the phosphor particles can be maintained favorably.

As described above, in FIG. 1, the configuration of the chamfered surface 24 has been described in relation to the optical axis Ac, the predetermined point Pu, the vertical plane Hu, and the inclined plane Hi. This is also applied to the configuration of the chamfered surface 46 of the chamfered groove 45. That is, the chamfered surface 46 is limited to the portion of the chamfered surface 24, which faces the optical path of the scanning light beam Bs from the MEMS mirror unit 13 to the reflection type phosphor plate 15.

In another embodiment, the chamfered grooves 45*a* and 45*b* are formed in the projection lens 41. However, the chamfered groove 45*b* on the side where there is no MEMS mirror unit 13 can be omitted. In this case, the bottom surface 43 is formed at the location of the chamfered groove 45*b*. Then, the MEMS mirror unit 13 is disposed along the inclined surface of the chamfered groove 45*a*. This configuration is effective in a case where only one MEMS mirror unit is used, and the area of the bottom surface increases at the position of the incident end point of the projection lens 81, so that the lens efficiency can be made higher than the lens efficiency in another embodiment (FIGS. 10A and 10B).

(Modification Example and Supplements)

In the embodiment, the vehicular headlights 10 and 40 have been described as the vehicular lamps. The vehicular lamp according to the present invention can be applied to lamps other than the vehicular headlight as long as the lamps are lamps that are mounted to a vehicle.

The reflection type phosphor plate 15 of the embodiment corresponds to the reflection type phosphor unit in the present invention. The reflection type phosphor unit in the present invention can also include the full-face heat sink 36 (FIG. 6).

In the embodiment, the laser light source 11 is used as the light source. The light source in the present invention may be an LED (Light Emitting Diode).

The bottom surface 23 of the embodiment is a flat surface. The bottom surface in the present invention may be a curved surface of a convex lens. Each of the projection lenses 19*a* and 41 is a convex lens in which the surface on the projection lens 19*b* side is a curved surface of the convex lens and the surface on the incident end point Pa side, that is, the bottom surface 23, is a flat surface.

In the embodiment, the predetermined point Pu is set on the phosphor surface of the reflection type phosphor plate 15. The predetermined point in the present invention can be set at any position as long as the position is on the reflection type phosphor plate 15 side rather than the incident end point Pa.

What is claimed is:

1. A vehicular lamp comprising:

a light source that emits a light beam;

a mirror unit that emits a scanning light beam by reflecting the light beam from the light source by performing reciprocating rotation around two axes;

a reflection type phosphor unit that has a phosphor surface and receives the scanning light beam from the mirror unit to produce an image on the phosphor surface; and a projection lens unit that has an optical axis parallel to or common to a central axis perpendicular to the phosphor surface of the reflection type phosphor unit, and emits light emitted from the image incident from the reflection type phosphor unit in a direction from an incident end point on the optical axis to an emission end point on the optical axis to project the light onto an irradiation area, wherein in a case where an inclined plane that intersects with the optical axis at a predetermined point on the reflection type phosphor unit side with respect to the incident end point of the projection lens unit on the optical axis and becomes more distant from the optical axis in a predetermined radial direction of the projection lens unit as the inclined plane proceeds from the predetermined point toward the emission end point on the optical axis is defined, the projection lens unit has a bottom surface that is formed inside the inclined plane in the predetermined radial direction of the projection lens unit at a position of the incident end point and on which the light emitted from the image from the reflection type phosphor unit is incident, and a chamfered surface that is included in the inclined plane and formed outside the bottom surface in the predetermined radial direction.

2. The vehicular lamp according to claim 1, wherein a relative positional relationship between the mirror unit and the reflection type phosphor unit is set such that at least a part of the scanning light beam from the mirror unit to the reflection type phosphor unit crosses a projection plane obtained by projecting the chamfered surface onto a vertical plane that includes the incident end point and is perpendicular to the optical axis.

3. The vehicular lamp according to claim 2, further comprising:

a condensing lens that condenses the scanning light beam from the mirror unit on the reflection type phosphor unit such that the condensing lens is at least partially located within a range between both ends of the chamfered surface in the predetermined radial direction and within a range between the projection plane and the chamfered surface in a direction of the optical axis.

4. The vehicular lamp according to claim 1, wherein the phosphor surface of the reflection type phosphor unit has a rectangular shape having a short side and a long side, and the predetermined radial direction is a direction parallel to the short side.

5. The vehicular lamp according to claim 4, wherein the vehicular lamp is a vehicular headlight, and a relative positional relationship between the mirror unit and the reflection type phosphor unit is set such that scanning with the scanning light beam in directions of the long side and the short side on the phosphor surface of the reflection type phosphor unit produces images in a horizontal direction and a vertical direction of the irradiation area.

6. The vehicular lamp according to claim 2, wherein the phosphor surface of the reflection type phosphor unit has a rectangular shape having a short side and a long side, and the predetermined radial direction is a direction parallel to the short side.

7. The vehicular lamp according to claim 6, wherein the vehicular lamp is a vehicular headlight, and a relative positional relationship between the mirror unit and the reflection type phosphor unit is set such that scanning with the scanning light beam in directions of the long side and the short side on the phosphor surface of the reflection type phosphor unit produces images in a horizontal direction and a vertical direction of the irradiation area.

8. The vehicular lamp according to claim 3, wherein the phosphor surface of the reflection type phosphor unit has a rectangular shape having a short side and a long side, and the predetermined radial direction is a direction parallel to the short side.

9. The vehicular lamp according to claim 8, wherein the vehicular lamp is a vehicular headlight, and a relative positional relationship between the mirror unit and the reflection type phosphor unit is set such that scanning with the scanning light beam in directions of the long side and the short side on the phosphor surface of the reflection type phosphor unit produces images in a horizontal direction and a vertical direction of the irradiation area.

* * * * *